United States Patent [19]

Redkey

[11] Patent Number: 4,944,517

[45] Date of Patent: Jul. 31, 1990

[54] GOLF PRACTICE CLUB

[76] Inventor: Robert H. Redkey, 1630 Maple, Solvang, Calif. 93463

[21] Appl. No.: 446,930

[22] Filed: Dec. 6, 1989

[51] Int. Cl.[5] ..... A63B 69/36

[52] U.S. Cl. ..... 273/186 A; 273/193 R; 273/77 A

[58] Field of Search ..... 273/186 A, 186 R, 186 C, 273/186 E, 193 R, 194 R, 194 A, 194 B, 162 E, 167 E, 167 H, 167 J

[56] References Cited

U.S. PATENT DOCUMENTS 1,877,820 9/1932 Costello ..... 273/193 R
3,126,206 3/1964 Sabia ..... 273/186 A

FOREIGN PATENT DOCUMENTS 1236982 6/1971 United Kingdom ..... 273/186 A

*Primary Examiner*—George J. Marlo
*Attorney, Agent, or Firm*—Price, Gess & Ubell

[57] ABSTRACT

A pair of arched rings have lateral extensions inserted in parallel block members to form a channel extended from a golf club shaft which, when properly swung, passes over a golf ball on a playing surface without disturbing the ball. The block members are provided with lateral extensions simulating putter feet and longitudinal extensions to increase the effective channel length, thereby further compelling a correct stroke by the player.

8 Claims, 1 Drawing Sheet

GOLF PRACTICE CLUB

BACKGROUND OF THE INVENTION

1. Field of the Invention

The subject invention relates to sporting equipment and, more particularly, to a golf practice club.

2. Description of the Prior Art

In the prior art, various aids have been suggested for improving the golf swing. These aids mainly involve alignment devices for aiding in proper club alignment. In general, improving the golf swing has typically involved repetitive hitting of the golf ball with the club. This, of course, entails the disadvantage of requiring a relatively large space and a supply of balls, which must be retrieved in some manner.

Efforts at improvement over such prior art practice techniques have been suggested. Sabia, U.S. Pat. No. 2,621,044, discloses a flat-bottomed channel formed in the top of a club head, which swings under a tethered, simulated ball. Sloan, U.S. Pat. No. 3,126,206, discloses an adapter providing a rectangular opening which is attached by a strap to the bottom of a club. Sloan suggests his adapter could be strapped to the bottom of a putter. These approaches have the disadvantage that they diverge from a real-life playing situation.

Applicant's copending application, U.S. Ser. No. 274,019, discloses a golf practice club which contains an opening somewhat larger than a golf ball. The opening is designed such that when a perfect swing is made over the golf ball, the golf ball does not move. The ball will only be struck when the club stroke is imperfect in some manner.

The invention of Applicant's copending application provides a useful, more realistic golf practice club. Nevertheless, it is considered that this club exhibits certain drawbacks, particularly in that it is relatively expensive and difficult to manufacture, typically requiring expensive casting techniques.

SUMMARY OF THE INVENTION

Accordingly, it is an object of the invention to provide an improved golf practice club;

It is another object to provide an improved golf practice club of the type wherein the club is swung over a stationary ball on a hitting surface; and It is yet another object to provide a golf practice club of such type which is relatively inexpensive and easy to manufacture.

According to the invention, one or more arched ring members are provided. These arched rings fit into first and second block members, and the assembly provides an arched channel through which a golf ball may pass. At least one ring is preferably received in the blocks by top surface openings therein, and is preferably held by locking means on side inserts, which double as simulated putter feet extensions.

BRIEF DESCRIPTION OF THE DRAWINGS

The just-summarized invention will now be described in detail in conjunction with the drawings, of which.

DETAILED DESCRIPTION OF THE PREFERRED EMBODIMENTS

Figure 1:
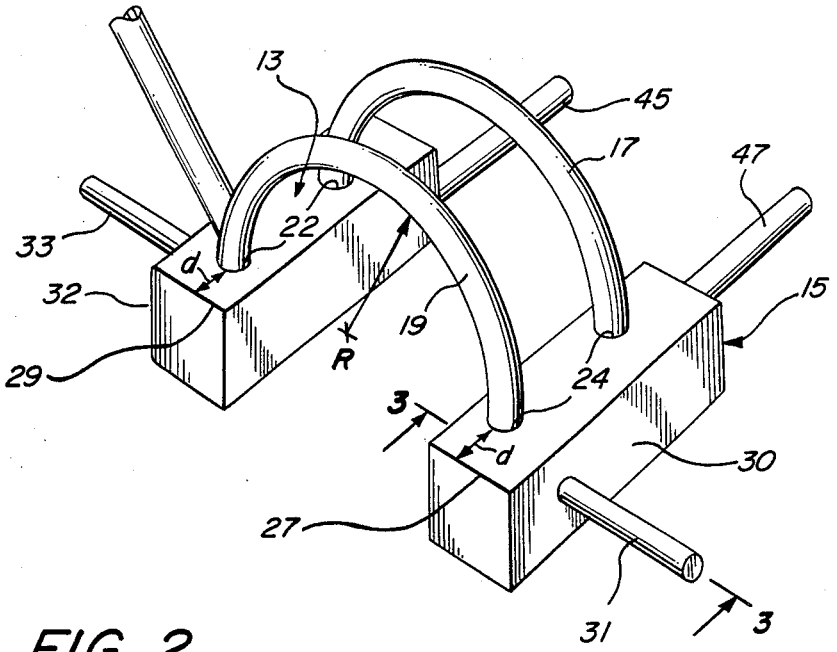
FIG. 1 is a perspective view of a preferred embodiment.

In FIG. 1, first and second putter blocks 13, 15 are shown. These blocks are generally rectangular in a cross-section taken at 3—3 of FIG. 1. First and second rings 17, 19 insert into holes 22, 24 drilled in the respective blocks 13, 15. The holes 22 are spaced the same distance apart as the holes 24 and the distances "d" of the first of each of the holes 22, 24 from the edge 29, 27 of each block 13, 15 is the same. The rings 17, 19 are circular in cross-section, and each contain parallel lateral extensions 28, which extend into the holes 22, 24 drilled in the blocks 13, 15. The rings 17, 19 are preferably identically formed.

In the sides 30, 32 of each respective block 13, 15 are inserted a respective horizontal rod or dowel member 31, 33. The members 31, 33 are preferably threaded into the blocks 13, 15 so that they may be removed to facilitate insertion of different-sized rings 19, as hereafter described in further detail.

The rod members 31, 33 are preferably plastic coated for attractive appearance, and extend a length selected to simulate putter feet. The shape of the plastic coating may also be chosen to further add to the appearance of putter feet.

A pair of members 31, 33 may be provided in each block 13, 15, if desired, instead of the single rod 31, 33 in each block, and the pair encased in a plastic coating further simulating putter feet, again as desired.

Figure 3:
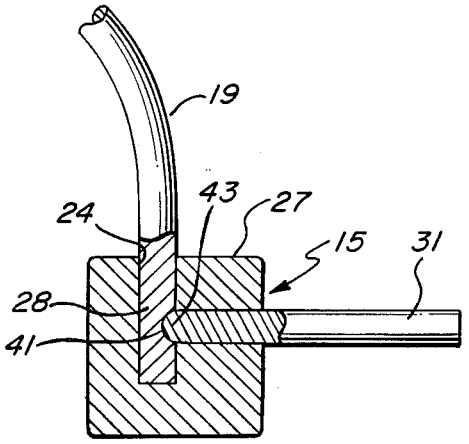
FIG. 3 is a side sectional view taken at 3—3 of FIG. 1.

As shown in FIG. 3, at least one arched ring 19 has each of its parallel extensions 28 indented by an indentation or female portion 41, which receives a male locking dimple 43 formed on the end of each lateral rod 31, 33 to positively retain the ring 19. The positive locking action helps eliminate wobbling of the overall structure. With the assembly positively retained in this fashion, the second ring 17 may simply be press-fit into the blocks 13, 15, if desired.

Longitudinally arranged parallel rods 45, 47 are also provided and are inserted into the respective blocks 13, 15 perpendicular to the plane of the cross-section of FIG. 3—3, i.e., parallel to the path of a correct swing. These rods 45, 47 contribute to compelling a correct stroke of the club. The rings 17, 19, putter blocks 13, 15, lateral rods 31, 33, and longitudinal rods 45, 47 may be fabricated of well-known materials such as metal or various ceramics.

Figure 2:
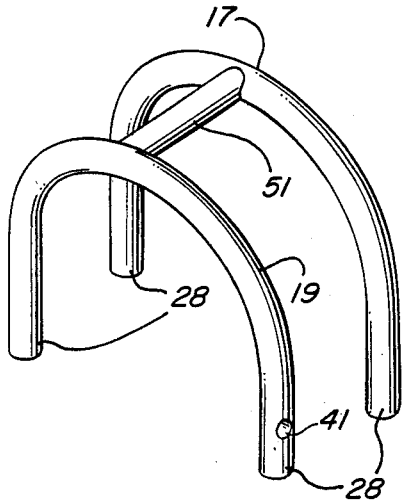
FIG. 2 is a partial perspective view illustrating a second arch means embodiment.

FIG. 2 illustrates an alternative arched ring structure in which the two arched rings 17, 19 are united by a crossbar or rod member 51. The structure of FIG. 2 may be configured, for example, by welding a crossbar or rod 51 to the two parallel ring members 17, 19 or by forming the structure of FIG. 2 as a unitary member. The structure of FIG. 2 exhibits additional strength and rigidity and increases the cohesiveness of the overall structure when ring 19 is retained by screwed-in members 31, 33, as shown in FIG. 3, and ring 17 is simply press fit or glued in its respective holes 22, 24.

In use, the club 11 is swung over a stationary ball, a correct swing being obtained when the arched club passes over the ball, leaving the ball undisturbed. The rings 17, 19 may be of a radius R which is, for example, ⅛-inch larger than the diameter of a standard golf ball, which is 1.68 inches.

Pairs of rings 17, 19 may be provided, each pair providing an increasingly smaller opening and being color coded, if desired, to simulate grades of difficulty, such as beginner, amateur, and pro. As a beginner improves, he may change the opening size by substituting a new ring pair 17, 19 for one with a larger opening. A perfect swing results in no movement of the ball 22, while a less perfect swing may just nick the ball, or may move it substantially.

To make a perfect putt, the golfer must practice and achieve the skills of keeping the eyes on the ball, keeping the head down, making a perfect back and forward stroke, and making a perfect follow through. As skills increase, a club with a narrower opening may be used to increase the challenge.

As will be understood, the foregoing embodiments are subject to numerous adaptations and modifications without departing from the scope and spirit of the invention. Therefore, it is to be understood that within the scope of the appended claims, the invention may be practiced other than as specifically described herein.

What is claimed is:

1. A golf practice club for practice swinging at a golf ball comprising:

first and second block means for providing a channel therebetween, said block means each including a respective hole in a top surface thereof;

at least one arched ring means having first and second extensions thereon for insertion respectively in one of said holes; and said first and second block means and said at least one arched ring providing an opening for passing over said golf ball without touching said ball when a proper swing is made.

2. The practice club of claim 1 further including a second arched ring inserted into said first and second block means and cooperating with said first arch means and first and second block means to form said channel.

3. The practice club of claim 2 further including means for attaching said first and second arched rings together.

4. The practice club of claim 1 further including first and second lateral insert means for insertion into first and second respective sides of said first and second block means for retaining said at least one arched ring means therein.

5. The practice club of claim 3 wherein said first and second extensions each include a female engagement means and said first and second lateral insert means include respective means for engaging said female engagement means.

6. The practice club of claim 5 further including first and second longitudinal extensions inserted into a respective one of said first and second block means.

7. The practice club of claim 6 further including a second arched ring inserted into said first and second block means and cooperating with said first arch means and first and second block means to form said channel.

8. The practice club of claim 7 further including means for attaching said first and second arched rings together.

* * * * *